US007614598B2

(12) United States Patent
Smith

(10) Patent No.: US 7,614,598 B2
(45) Date of Patent: Nov. 10, 2009

(54) APPARATUS FOR RETAINING SHEETS AGAINST A BACK SURFACE

(76) Inventor: David C. Smith, 5140 E. 100 South, Lebanon, IN (US) 46052

( * ) Notice: Subject to any disclaimer, the term of this patent is extended or adjusted under 35 U.S.C. 154(b) by 159 days.

(21) Appl. No.: 11/732,774

(22) Filed: Apr. 4, 2007

(65) Prior Publication Data

US 2008/0245943 A1 Oct. 9, 2008

(51) Int. Cl.
*A47B 97/04* (2006.01)

(52) U.S. Cl. ..... 248/452; 248/442.1; 24/67 R; 24/67.3; 24/67.7

(58) Field of Classification Search ..... 248/444.2, 248/452, 453; 24/67 R, 67.3, 67.5, 67.7
See application file for complete search history.

(56) References Cited

U.S. PATENT DOCUMENTS

| | | | | |
|---|---|---|---|---|
| 1,417,009 | A | 5/1922 | Woodward | |
| 3,399,429 | A | 9/1968 | Goodman | |
| 3,675,782 | A | 7/1972 | Dudley | |
| 4,172,609 | A * | 10/1979 | Marsh | 292/224 |
| 4,219,910 | A * | 9/1980 | Kruska et al. | 24/523 |
| 4,693,443 | A | 9/1987 | Drain | |
| 5,152,490 | A * | 10/1992 | Deutsch | 248/452 |
| 5,170,982 | A | 12/1992 | Schulteis et al. | |
| 5,592,721 | A | 1/1997 | Zeller | |
| 5,711,430 | A | 1/1998 | Andersen et al. | |
| 5,745,962 | A | 5/1998 | Richter | |
| 6,182,936 | B1 * | 2/2001 | Yang | 248/442.2 |
| 6,302,362 | B1 | 10/2001 | Moore | |
| 6,470,536 | B1 | 10/2002 | Kettlestrings et al. | |
| 2007/0262223 | A1 * | 11/2007 | Wang et al. | 248/346.07 |

* cited by examiner

*Primary Examiner*—Amy J. Sterling
(74) *Attorney, Agent, or Firm*—Maginot, Moore & Beck LLP

(57) ABSTRACT

An apparatus for retaining at least one sheet against a back surface is disclosed herein. In at least one embodiment, the apparatus comprises a wedge member, a roller member, a biasing member, and a release mechanism. The roller member is moveable between a first position where the roller surface contacts the wedge member and a second position where the roller surface is separated from the wedge member. The biasing member biases the roller member toward the first position. The release mechanism is connected to the roller member and moveable between a clamp position and a release position. The release mechanism moves the roller member from the first position to the second position when the release mechanism is moved from the clamp position to the release position.

20 Claims, 4 Drawing Sheets

APPARATUS FOR RETAINING SHEETS AGAINST A BACK SURFACE

FIELD

This invention relates to an apparatus for holding sheet material against a back surface.

BACKGROUND

Clip boards are commonly used in various settings including business offices, medical offices, construction sites, gymnasiums, and retail establishments. Clip boards are used to retain one or more flexible pieces of paper or other sheets against a rigid board or other back surface. A clamp member is typically used to retain the sheets against the back surface.

When the sheets are retained against the rigid back surface of a clip board, the user is provided with a hand-held writing surface which might otherwise be unavailable. In addition to providing a hand-held writing surface, clip boards also serve numerous other convenient functions. For example, a clip board may serve as a clamping device for simply retaining a plurality of sheets together. As another example, a clip board may serve as a rigid backing device providing a solid structure for one or mole sheets when passed from one person to another or when being held by an individual for viewing away from a desk or table.

With typical boards, a user wishing to insert an additional sheet into the clip board must press down on the tab of the clamp member with one hand in order to release the clamping action of the clamp member against the board. The user is then able to insert a piece of paper between the clamp member and the board with the other hand. This two handed action is often inconvenient when one of the user's hands is already occupied. For example, if the user is holding a small cellular telephone against his or her ear, it may be difficult for the user to simultaneously insert an additional sheet of paper into a traditional clipboard.

While sheet retaining apparatus have been provided in the past that would allow a user to insert a sheet into a clamping device with a single hand, such previous sheet retaining apparatus have relied on the use of gravity to maintain a clamping force on the sheets. However, users of clipboards often orient the boards in numerous directions including sideways and up-side-down. Accordingly, these past sheet retaining devices which rely on gravity to maintain a clamping force on the sheets are not useful for incorporation as part of a clip board.

Another concern with past clip boards having a clip attached to a board involves the accidental removal of the sheets from the clamp member. In particular, when the user grabs the clip board by the clamp member, the release lever on the clamp member may be accidentally depressed. Accidental depression of the clamp member typically causes the sheets held by the clip board to be released from the clip board, and they may fall to the ground.

Accordingly, it would be advantageous to provide an apparatus for retaining sheets against a rigid back surface wherein only a single hand is required to insert the first or additional sheets into the apparatus. It would also be advantageous if such sheet retaining apparatus could be oriented in any direction without the sheet retaining apparatus losing its clamping force against the sheets. Furthermore, it would be advantageous if such sheet retaining apparatus included a release mechanism configured to avoid accidental release of sheets from the apparatus. It would be desirable to provide a clip board or other sheet retaining apparatus that provides one or more of these or other advantageous features as may be apparent to those reviewing this disclosure. However, the teachings disclosed herein extend to those embodiments which fall within the scope of the appended claims, regardless of whether they accomplish one or more of the above-mentioned advantages.

SUMMARY

An apparatus for retaining at least one sheet against a back surface is disclosed herein. In at least one embodiment, the apparatus comprises a wedge member, a roller member, a biasing member, and a release mechanism. The roller member is moveable between a first position where the roller surface contacts the wedge member and a second position where the roller surface is separated from the wedge member. The biasing member biases the roller member toward the first position. The release mechanism is connected to the roller member and moveable between a clamp position and a release position. The release mechanism moves the roller member from the first position to the second position when the release mechanism is moved from the clamp position to the release position.

In one embodiment, the apparatus is provided as a clip board comprising a generally planar back surface and a sheet retaining member positioned upon the back surface. The sheet retaining member comprises a wedge surface, a rotatable roller, and a biasing member. The wedge surface has an incline relative to the back surface. The roller is positioned between the wedge surface and the back surface and moveable between a first position where the roller contacts the wedge surface and a second position where the roller is removed from the wedge surface. The biasing member provides a force which biases the roller toward the wedge surface and also toward the back surface.

The above described features and advantages, as well as others, will become more readily apparent to those of ordinary skill in the art by reference to the following detailed description and accompanying drawings.

DESCRIPTION

Figure 1:
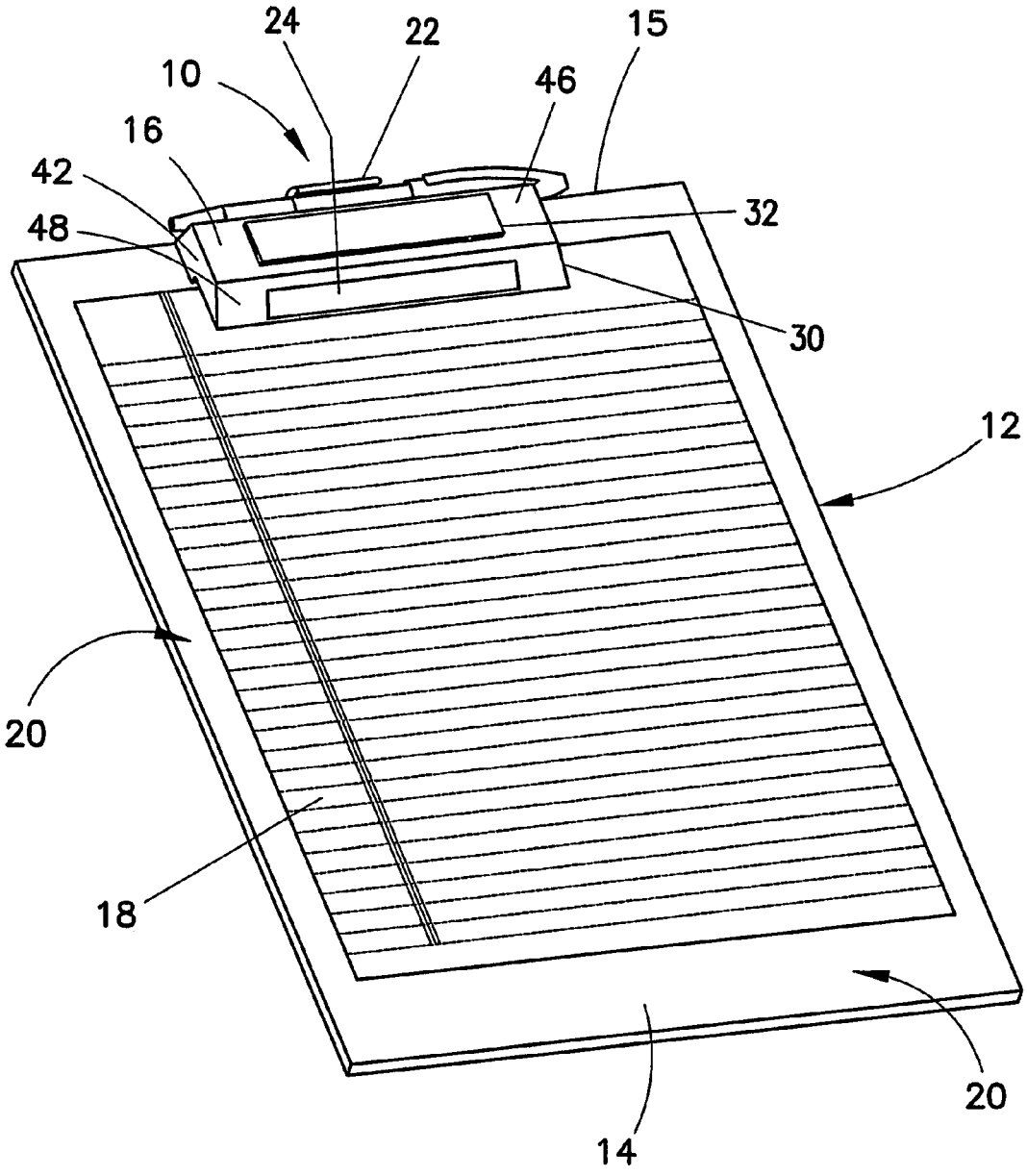
FIG. 1 shows a perspective view of one embodiment of a sheet holder including a board and a clamping member positioned at the top of the board.

One embodiment of an apparatus 10 for retaining sheets against a back surface is shown in FIG. 1 in the form of a clip board 12. The apparatus 10 generally comprises a board 14 with a clamp member 16 affixed thereto.

The board 14 provides a generally flat back surface 20 against which one or more sheets 18 are held. The word "sheet" as used herein refers generally to a generally flat artifact that is thin relative to its length and width, and may comprise paper, plastic, cloth, or other thin flexible materials. The board 14 is generally rectangular in shape and is sized slightly larger than the sheets 18 to be retained. For example, the board 14 may be 10"×13" in size, allowing a standard letter or A-4 sized sheet of paper to easily fit against the surface 18. The board is generally rigid and may be comprised of any of numerous materials, such as plastic, wood, particle board, glass, or other materials.

As shown in FIG. 1, the clamp member 16 is fixed to the board 14 near a perimeter edge 15 of the board. The clamp member 16 comprises a housing 30 which forms a head on the board 14 and covers internal components of the clamp member. The clamp member 16 acts to trap sheets 18, such as sheets of paper or plastic between the clamp member 16 and the board 14, thus securing the sheets to the apparatus. An activation device in the form of a release button 32 is centered upon the housing 30. As explained in further detail below, activation of the release button 32 releases the clamp provided on the sheets by the clamp member 16, allowing the sheets to be removed from the apparatus.

The clamp member housing 30 generally forms the shape of a trapezoidal prism. The housing includes two parallel sidewalls 40, 42, a rear wall 44 (see FIG. 2), an upper face 46, and an angled front face 48. The angled front face 48 is provided at an angle relative to the board 14, while the upper face 46 is generally parallel to the board 14. The release button 32 extends above the surface of the upper face 46.

Figure 2:
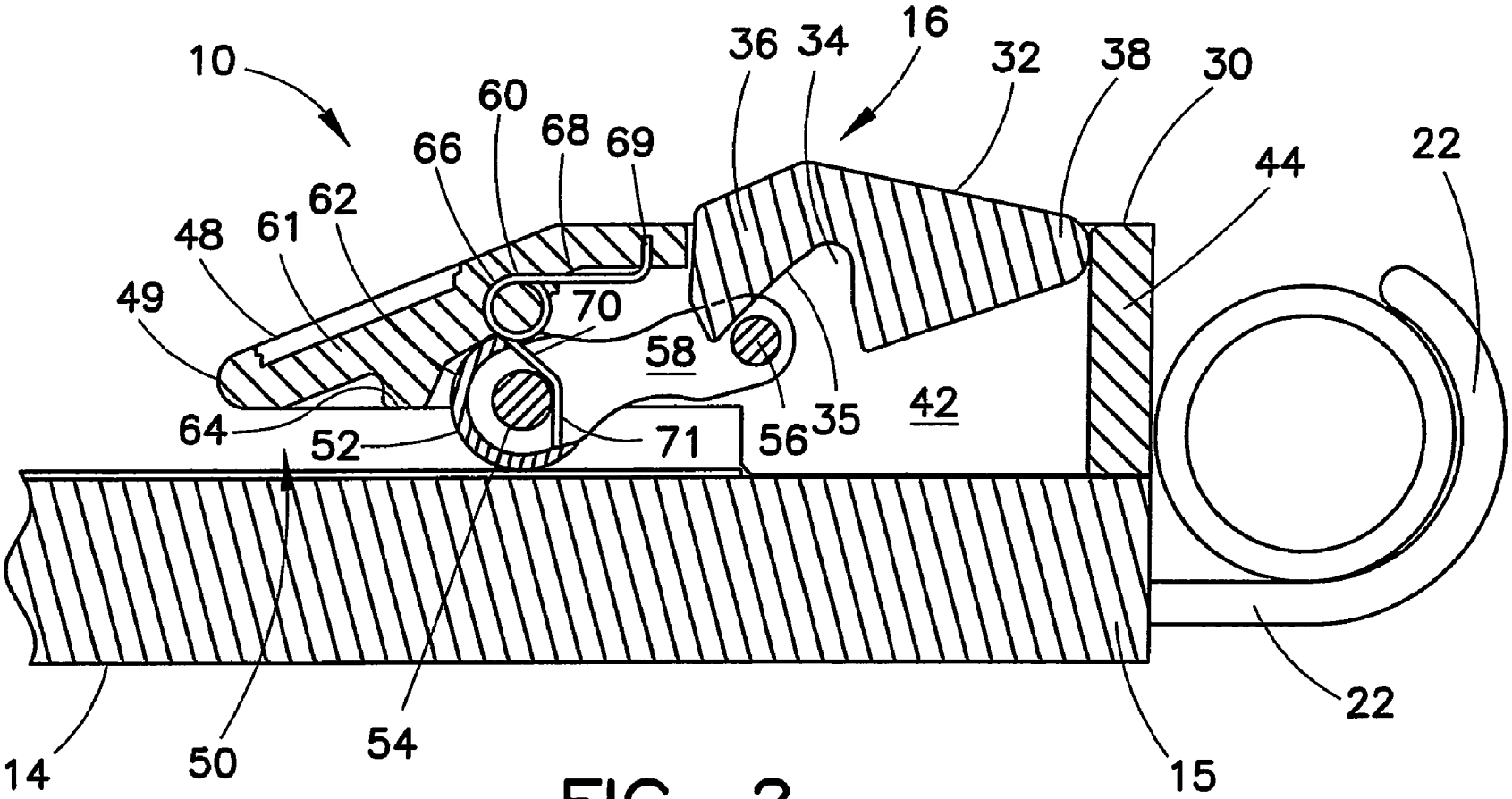
FIG. 2 shows a cross-sectional view of the clamping member of FIG. 1 in a clamping position, the clamping member including a roller and a biasing member.

As shown in FIG. 2, the front face 48 of the clamp member housing 30 includes a front edge 49 that is removed from the board by a distance. A slot 50 is formed between the board 14 and the housing 30 starting at the front edge 49 of the housing 30 and extending to a middle portion of the housing. The height of the slot 50 provides a limit to the number or total thickness of the sheets that may be inserted into the clamp member 16. For example, the slot may be between 0.10 inch and 0.25 inch. In one embodiment, the slot is greater than 0.22 inch, allowing a standard paper pad to be inserted in the slot 50 between the board 14 and the housing 30.

Figure 3:
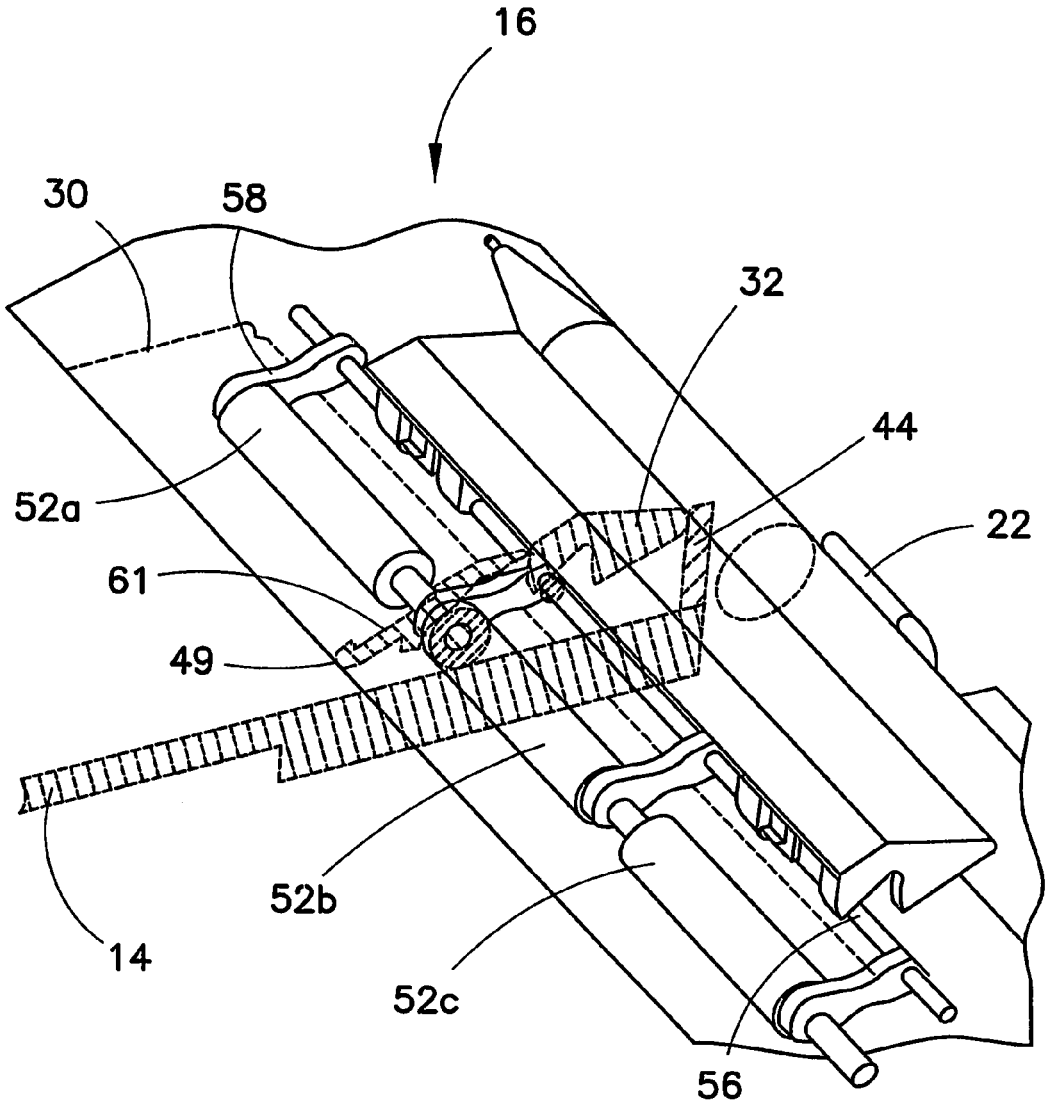
FIG. 3 shows a perspective view of the roller of the clamping member of FIG. 2 and its connection to a release button.

The internal mechanical components of the clamp member 16 are provided under the shell of the clamp member housing 30. With reference to FIGS. 2 and 3, these mechanical components include a roller 52 rotatably mounted upon on a roller shaft 54. The roller 52 is generally cylindrical in shape and is comprised of a plastic material. In one embodiment, the roller 52 may be a generally hard plastic. However, in other embodiments, the roller 52 may exhibit some elastic surface qualities which allow the roller to better grip the surface of the sheets 18. For example, in one embodiment the roller 52 may comprise a composite plastic material with a thermoplastic elastomer on the outside surface or other rubber type covering.

As best seen in FIG. 3, the roller 52 may be split into several roller components, such as rollers 54*a*, 54*b*, and 54*c*. The roller components 54*a*-54*c* are all provided upon the roller shaft 54. The roller shaft 54 is provided as part of a rack structure formed by the roller shaft 54, a release bar 56, and a plurality of rigid connecting members 58. The release bar 56 is journaled within opposing slots provided in the sidewalls 40, 42 of the housing 30. The slots allow the release bar 56 to move within the slot between a forward position and a rear position, wherein movement of the release bar 56 is generally in a direction parallel to the surface of the board 20.

The release button 32 provides another component of the release mechanism. With reference again to FIG. 2, the release button 32 includes a mouth 34 provided along a lower surface of the release button. The release bar 56 of the rack engages the mouth 34 of the release button 32, and particularly a jaw surface 35 of the mouth 34, with the jaw surface 35 provided at an angle with respect to the board surface 20. During engagement of the release bar 56 and the mouth 34, the jaw surface 35 contacts an upper forward portion of the release bar 56.

The release button 32 is pivotable with respect to the housing 30 such that a forward portion 36 of the release button 32 is configured to move in a generally up and down or circumferential direction while a rear portion 38 of the release button 32 pivots about an axis. Accordingly, the rear portion 38 of the release button may be pivotably mounted to the housing along cylindrical tabs of the release button 32 that extend into the sidewalls 40, 42 of the housing 30. The engagement of the mouth 34 of the release button 32 with the release bar 56 is such that downward movement of the release button 32 forces the release bar 56 in a rearward direction, toward the rear wall 44 of the housing 30, as explained in further detail below.

With continued reference to FIG. 2, a biasing member 60 is retained within the housing 30. The biasing member 60 biases the roller 52 toward a wedge 61 provided on the opposite side of the angled front face 48 of the housing 30. The wedge 61 includes a wedge surface 62 that is arranged at an angle with respect to the flat surface 20 of the board 14. The wedge surface 62 includes a forward lip 64 that extends downward toward the board 14 and preventing movement of the roller past the lip 64.

The angle of the wedge surface 62 provides an incline for the roller 52 toward the board 14. Thus, when the surface of the roller 52 moves along the wedge surface 62 under the encouragement of the biasing member 60, the roller 52 is also encouraged downward toward the board 14. The force provided by the biasing member 60 causes the roller 52 to become wedged between the wedge surface 62 and the board 14, or if sheets are present, between the wedge surface and the sheets 18, thus trapping the sheets between the board 14 and the roller 52. In this wedged position, the roller 52 is prevented from rotating.

In the embodiment of FIG. 2, the biasing member 60 is provided as a spring. The spring 60 is comprised of a metal material and includes a center coil portion 66, a first spring arm 68, and a second spring arm 70. The first spring arm 68 is fixed in place to the housing 30. A finger 69 provided on the end of the first spring arm 68 is used to secure the spring arm to the housing. In particular the finger 69 is retained within a slot formed in the housing 30 which holds the spring 60 in place. A finger 71 is also provided on the second spring arm 70. The second spring arm 70 and its finger 71 contact the roller shaft 54. The resilient coil portion 66 of the spring 60 is compressed within the clamp member 16 and acts to force the two spring arms 68, 70 away from each other, thus providing the biasing force which encourages the roller shaft 54 and roller 52 toward the wedge surface 62, and downward toward the board 14.

Operation of the apparatus 10 will now be explained with reference to FIGS. 2 and 4. First, with reference to FIG. 2, the release mechanism is shown in the clamp position and configured to retain sheets within the clamp. When a user wishes to retain one or more sheets 18 on the board 14 using the clamp member 16, the user simply slides the sheets along the board 14 and under the front edge 49 of the clamp member. When the sheets 18 contact the roller 52, the roller will rotate and accept the sheets between the roller 52 and the board 14. Only a small force is required to insert the sheets under the roller 52. In particular, this force must only cause the second spring arm 70 to pivot slightly away from the board, allowing the roller 52 to be removed from the wedge surface 62 such that it can rotate as the sheets 18 move under the roller 52. This roller movement allows entry of the sheets 18 between the clamp apparatus 16 and the board 14. Because there is no requirement to activate the release button 32 of the clamp member 16 when inserting sheets 18, the sheets may be easily inserted by the user with a single hand by simply sliding the sheets along the board 14 and under the clamp member 16.

Once the sheets 18 are inserted under the roller 52, they are wedged in place. When a force pulls the sheets away from the clamp member 16, the roller 52 is prevented from rotating because it is wedged against the wedge surface 62. Furthermore, the force pulling the sheets away from the clamp member 16 also increases the retention force upon the sheets, because the sheets will further encourage the roller 52 along the incline and into a stronger wedge relationship between the wedge surface 62 and the board 14. This stronger wedge relationship results in a stronger trapping force on the sheets. Also, because of the biasing force from the spring 60 which maintains the wedge relationship between the roller 52 and the board 14 regardless of orientation of the board, the clip board 12 may be positioned in any orientation without the clamp member 16 releasing the sheets 18.

In order to release the sheets from the clamp member 16, the user presses down on the release button 32, forcing the release button toward the board 14. FIG. 4 shows the release mechanism in a release position with the release button 32 pressed down and the roller 52 removed from the wedge surface 62. This is in contrast to FIG. 2 which shows the release mechanism in the clamp position with the release button 32 in an upward position and the roller 52 in contact with the wedge surface 62.

When the release button 32 is pressed by the user, the release button pivots such that the rear portion 38 of the release button rotates about an axis and the forward portion 36 of the release button rotates downward toward the board 14. During this movement, the mouth 34 of the release button engages the release bar 56, pulling the release bar 56 toward the rear wall 44 of the housing 30 in a manner that is generally parallel to the board 14. Because the release bar 56 is attached to the roller shaft 54, the roller shaft 54 and the roller 52 are also pulled toward the real wall 44 of the housing, providing a force on the roller 52 and shaft 54 in a direction opposite the force provided by the spring. This opposite force is greater than that of the spring 60 and releases the roller 52 from contact with the wedge surface 62. As the roller 52 is moved toward the rear wall 44, the spring 60 is further compressed, with the second spring arm 70 moving toward the first spring arm 68.

Figure 4:
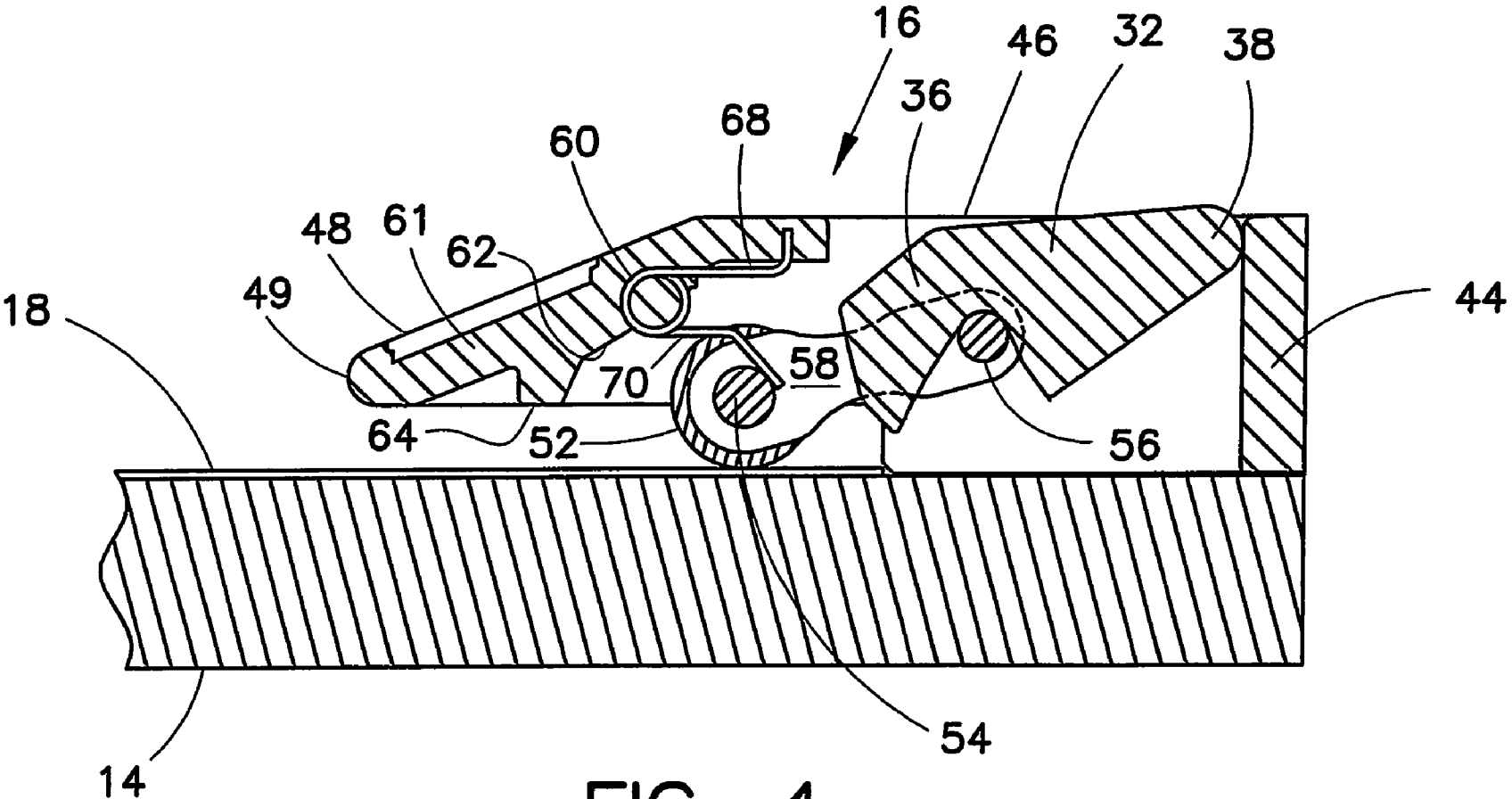
FIG. 4 shows a cross-sectional view of the clamping member of FIG. 2 in a release position.

With the release mechanism in the unlocked position of FIG. 4, the second spring arm 70 provides a force on the roller shaft 52 which encourages the roller 52 in a direction toward the wedge 61 and the board 14. The position of the release bar 56 closer to the rear wall 44 keeps the roller 52 removed from the wedge 61. At the same time, the downward spring force keeps the roller 52 in contact with the sheets 18. Accordingly, the roller 52 continues to trap the sheets 18 against the board 14 even after the release button 32 is depressed.

When the user wishes to remove the sheets 18 from the clamp member 16, the user pulls the sheets away from the clamp member with the release button 32 depressed. Because the release button 32 removes the roller 52 from the wedge 61, as shown in FIG. 4, the roller 52 is free to rotate. When the user pulls the sheets 18 away from the clamp member 16, the roller 52 rolls over the sheets 18 as they slide out from under the roller 52. Only a relatively small force is required to release the sheets 18 from the roller 52 because the roller 52 is freely rotating and only the downward component of the spring biasing force is trapping the sheets 18 against the board 14. Accordingly, the clamp member 16 provides a clip board device that avoids accidental removal of the sheets by only releasing the sheets when a force is applied to the sheets to pull them away from the clamp member 16.

Returning again to FIG. 1, various features may be provided on the apparatus for the convenience of the user. For example, a pen/pencil holder 22 may be positioned on the apparatus 10 near the upper perimeter edge 15 of the board 12, above the clamp member housing 30. The pen/pencil holder may be, for example, a C-shaped clip, a ring through which a pen or pencil is inserted, or any of various other pen/pencil holders as will be recognized by those of skill in the art. The pen/pencil holder 22 may be formed integral with the clamp member housing 30 or may be attached to the apparatus using some fixation means such as a pin or clip.

Another exemplary feature that may be provided on the apparatus is a name plate. As shown in FIG. 1, the name/graphics plate 24 is provided on the angled front face 48 of the clamp member housing 30. The angle of the front face 48 is generally provided at an angle between 20° and 70° relative to the board, which allows the markings on the name/graphics plate to be easily viewed from above the clipboard 12 or from a lower side portion of the clip board. The name/graphics plate 24 may be integral with the front surface or may be attached to the front surface using some fixation means, such as an adhesive a snap arrangement. The name/graphics plate 24 may be used for numerous purposes and include various markings. For example, the name/graphics plate 24 may be marked with a company or individual name. The name may indicate, for example, the owner of the clipboard, the maker of the clipboard, or some marketed entity, such as a college or professional sports team. A logo, design or other indicia may be provided on the name/graphics plate 24 in addition to or in lieu of a name.

Although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. An apparatus for retaining at least one sheet against a back surface, the apparatus comprising:

a) a wedge member;

b) a roller member including a roller surface, the roller member moveable between a first position where the roller surface contacts the wedge member and a second position where the roller surface is separated from the wedge member, wherein the roller member is blocked from rotating when the roller member is in the first position, and wherein the roller member is free to rotate about an axis of rotation when in the second position; and c) a biasing member biasing the roller member toward the first position.

2. The apparatus of claim 1 further comprising a release mechanism connected to the roller member and moveable between a clamp position and a release position, the release mechanism configured to move the roller member from the first position to the second position when the release mechanism is moved from the clamp position to the release position.

3. The apparatus of claim 2 wherein the roller member and biasing member are housed within a head provided on the back surface.

4. The apparatus of claim 3 wherein the wedge member comprises a surface of the head.

5. The apparatus of claim 3 wherein the release mechanism includes a release button provided on the head.

6. The apparatus of claim 5 wherein the roller member comprises at least one roller cylinder provided on a roller shaft, wherein the release mechanism includes a release bar connected to the roller shaft, and wherein the release button is configured to slideably engages the release bar and move the roller member away from the wedge member.

7. The apparatus of claim 1 wherein the biasing member comprises a spring.

8. The apparatus of claim 1 wherein the biasing member is further configured to bias the roller member toward the back surface when the roller member is in the second position.

9. The apparatus of claim 1 wherein the apparatus is a clip board and the back surface is the board of the clip board.

10. An apparatus for retaining at least one sheet against a back surface, the apparatus comprising:

a) a wedge member;

b) a roller member rotatable about an axis, the roller member contacting the wedge member when a first force is applied to the roller member, and the roller member moving away from the wedge member when a second force is applied to the roller member in a direction opposite the first force, wherein rotation of the roller member is hindered when the roller member is in contact with the wedge member; and c) a biasing member applying the first force to the roller member to bias the roller member toward the wedge member.

11. The apparatus of claim 10 further comprising a release mechanism moveable between a first position and a second position, the release mechanism configured to apply the second force to the roller member when the release mechanism is moved from the first position to the second position.

12. The apparatus of claim 11 wherein the release mechanism comprises a button, wherein depression of the button moves the release mechanism from the first position to the second position.

13. The apparatus of claim 12 wherein the biasing member is configured to apply a force biasing the roller member toward the back surface when the release mechanism is in the second position.

14. The apparatus of claim 12 wherein the release mechanism comprises a rack positioned between the button and the roller member.

15. A clip board comprising:

a) a generally planar back surface; and b) a sheet retaining member positioned upon the back surface, the sheet retaining member comprising, i) a wedge surface having an incline relative to the back surface;

ii) a rotatable roller, the roller positioned between the wedge surface and the back surface and moveable between a first position where the roller contacts the wedge surface and a second position where the roller is removed from the wedge surface; and iii) a biasing member providing a force which biases the roller toward the wedge surface and also toward the back surface.

16. The clip board of claim 15 wherein the retaining member further comprises a release member configured to move the roller from the first position to the second position.

17. The clip board of claim 16 wherein the release member comprises an activation device and a rack, the rack positioned between the activation device and the roller.

18. The clip board of claim 15 wherein the biasing member comprises a spring, the spring including a first spring arm and a second spring arm, the first spring arm fixed in the retaining member, the second spring arm in contact with the roller and adapted to move when the roller moves between the first position and the second position.

19. An apparatus for retaining at least one sheet against a back surface, the apparatus comprising:

a) a roller member adjacent to the back surface, the roller member moveable between a first position and a second position, wherein the roller member is hindered from rotation in the first position and configured to retain the at least one sheet against the back surface, and wherein the roller member is freely rotatable about an axis of rotation in the second position such that the roller member rotates when the at least one sheet is moved relative to the back surface in a direction perpendicular to the axis of rotation;

b) means for biasing the roller member toward the first position; and c) means for moving the roller member to the second position.

20. An apparatus for retaining at least one sheet against a back surface, the apparatus comprising:

a) a roller member adjacent to the back surface, the roller member moveable between a first position and a second position, wherein the roller member is hindered from rotation in the first position and configured to retain the at least one sheet against the back surface, and wherein the roller member is freely rotatable about an axis of rotation in the second position such that the roller member rotates when the at least one sheet is moved relative to the back surface in a direction perpendicular to the axis of rotation;

b) a biasing member providing a force which biases the roller member toward the first position; and c) a release member configured to move the roller member from the first position to the second position.

* * * * *